US006601839B1

(12) United States Patent
Collins

(10) Patent No.: US 6,601,839 B1
(45) Date of Patent: Aug. 5, 2003

(54) VISE JAW PLATES AND COOPERATING WORK PIECE HOLDERS

(76) Inventor: Truman Collins, 600 Ellingson Rd. #S-7, Pacific, WA (US) 98047

( * ) Notice: Subject to any disclaimer, the term of this patent is extended or adjusted under 35 U.S.C. 154(b) by 663 days.

(21) Appl. No.: 09/245,640

(22) Filed: Feb. 8, 1999

Related U.S. Application Data

(63) Continuation of application No. 08/674,800, filed on Jul. 3, 1996, now abandoned.

(51) Int. Cl.[7] ..... B25B 1/29
(52) U.S. Cl. ..... 269/282
(58) Field of Search ..... 269/261, 262, 269/279–284; 35/536, 537

(56) References Cited

U.S. PATENT DOCUMENTS 2,621,807 A * 12/1952 Rendich ..... 269/900
2,754,708 A * 7/1956 Peterson ..... 269/266
3,463,478 A * 8/1969 Hennessey ..... 269/900
4,157,819 A * 6/1979 Meyer ..... 269/900
5,535,995 A * 7/1996 Swann et al. ..... 269/900
5,988,618 A * 11/1999 Meintrup et al. ..... 269/266

* cited by examiner

*Primary Examiner*—Robert C. Watson
(74) *Attorney, Agent, or Firm*—David L. Tingey

(57) ABSTRACT

Vise jaw plates and matching work piece holders cooperate to reliably secure an odd-shaped object in a preferred orientation between the plates. At least one of a plurality of work piece holders are disposed throughout the jaw in a uniform orthogonal pattern with the plate holes precisely aligned in rows and columns and spaced apart a same distance such that a selected work piece holder with one or more mount posts matching the jaw holes is mountable equally well throughout the plate. The assembly of accessories includes a plurality of dowels, a pivot bar, a sine bar, a V-block, an arc block, a curvilinear side block, and a parallel keeper.

5 Claims, 13 Drawing Sheets

37
4
9
8
39
40
37
38
36
36
7
6

VISE JAW PLATES AND COOPERATING WORK PIECE HOLDERS

This application is a continuation of this inventor's prior application filed in the U.S. Patent and Trademark Office on Jul. 3, 1996 and assigned Ser. No. 08/674,800 now abandoned.

BACKGROUND

1. Field of the Invention

This invention relates to vises and particularly to vise jaws and accessories thereto, specifically jaw plates and work piece holders used in combination with the plates.

2. Prior Art

It is known in the art to have general purpose vises with vise jaws appurtenant thereto with opposing flat surfaces for generally securing flat objects therebetween. Such vises are routinely used with mills, grinders, lathes, and machining centers.

Machining often requires accuracy to within 0.001" or less, requiring the vise to secure an object reliably to an accuracy of less than that tolerance. However, it is often difficulty to reliably secure an object that does not have at least one flat surface that can be secured against a vise while the object is oriented as necessary for the machine work. Heretofore, the capability to support a work piece in a preferred orientation in a vise remained unavailable, especially for irregularly-shaped objects.

SUMMARY

The primary object of the present invention is to provide a versatile vise jaw reconfigurable to secure a variety of shapes and sizes of work pieces in an advantageous orientation.

This object is achieved in a pair of opposing jaw plates each with front and back flat sides typical of vise jaws, the improvement in each comprising a precise uniform orthogonal pattern of holes in their front (opposing) sides. The holes are dual-purpose in receiving an unthreaded dowel or a threaded shoulder bolt, including a first unthreaded portion suitable for securely receiving a dowel closely therein. For securing the dowel in the unthreaded portion without wobble, the hole depth is twice its diameter. The hole terminates in a threaded portion immediately following the unthreaded portion and having a diameter less than that of the unthreaded portion diameter allowing bolt threads to pass through the unthreaded portion and engage the threads of the hole threaded portion. Thus, a bolt, such as a shoulder bolt, can be threaded into the hole threaded portion therein providing a positive attachment of the work piece holder to the plate. Typically, the unthreaded portion is sized to closely receive standard 5/16-inch dowel pins to a hole depth of 5/8-inch.

Another object is to provide that work piece holders with at least two dowels or bolts employed to secure the holder to a plate may be positioned on the plate at any advantageous position. This object is achieved in centers of the at two dowels or bolts being spaced apart a set distance, d, and with respective plate holes spaced apart from centers of vertical and horizontal neighboring plate holes said distance, d.

A further object is to provide a number of versatile jaw work piece holders as accessories to the versatile vise jaw plates, each with at least one dowel pin or shoulder bolt for insertion in the plate holes. Typically, two or more work piece holders advantageously selected from a collection of work piece holders are employed in concert with each other and in combination with the jaw plates to secure a work piece between the vise jaws. The work piece holders can be employed on one or both plates as may be dictated by the shape of the work piece.

Work piece holders include a plurality of dowels extendable in the holes beyond the jaw front side. Thus, for example, dowels placed in a first line of holes in the jaw together with dowels placed in a second line of holes orthogonal to the first line present a rectangular support for an object to be supported at 45-degrees in the jaw. Similarly, a dowel placed in the jaw may cooperate with another dowel or another different work piece holder, such as a sine bar, for example, elsewhere in the jaw to define a line for supporting an object at an angle. Likewise, two or more pins may serve to support curvilinear surfaces, such as a round, between the pins.

For other unusual shapes, such as an object with acute-angled surfaces to be secured, an different selective member from the collection of work piece holders can be employed, such as a pivot bar which comprises an elongated member with a flat longitudinal side with a dowel in its back side for engaging the jaw. The pivot bar then pivots on the dowel to match the angle of the object being secured in the vise. A pair of pivot bars or a pivot bar in concert with another work piece holder, such as a dowel, may be advantageously employed together to secure the object.

A sine bar is also provided in an elongated member having a hole on a pivot end through which a shoulder bolt passes into a jaw hole and on which the bar pivots. It can be tightened into a positive secured position on the plate by threading the shoulder bolt tightly into the jaw hole threads. Typically, the hole includes a concentric countersunk hole for receiving the bolt head within the work piece. The other end, or free end, of the elongated member is supported at a bar support pin by one from a set of blocks of calculated height intended to rest on the vise or by a selected work piece, such as an angle block or a cam block, described below. The support block or other work piece holder is then chosen that supports the free end at the desired height equal to the bar length.

A "V" block is useful for holding curvilinear objects vertically or horizontally, depending on its orientation. With a hole centered on the "V" and another on each side spaced apart to match those of the vise jaw, a dowel between the "V" block and jaw mounts the "V" block to the jaw. A single dowel mounted in the center hole allows the block to pivot to accommodate nonstandard shapes at any desired angle. A dowel in each of the outside block holes allows a vertical or horizontal orientation.

Yet another work piece holder is a spring-loaded parallel keeper, designed to hold parallels in place during machining operations, mounted to the versatile jaw with bolts passing through a mounting hole in a keeper mounting bar and entering jaw threaded holes from the jaw back.

DETAILED DESCRIPTION OF THE PREFERRED EMBODIMENT

Figure 1:
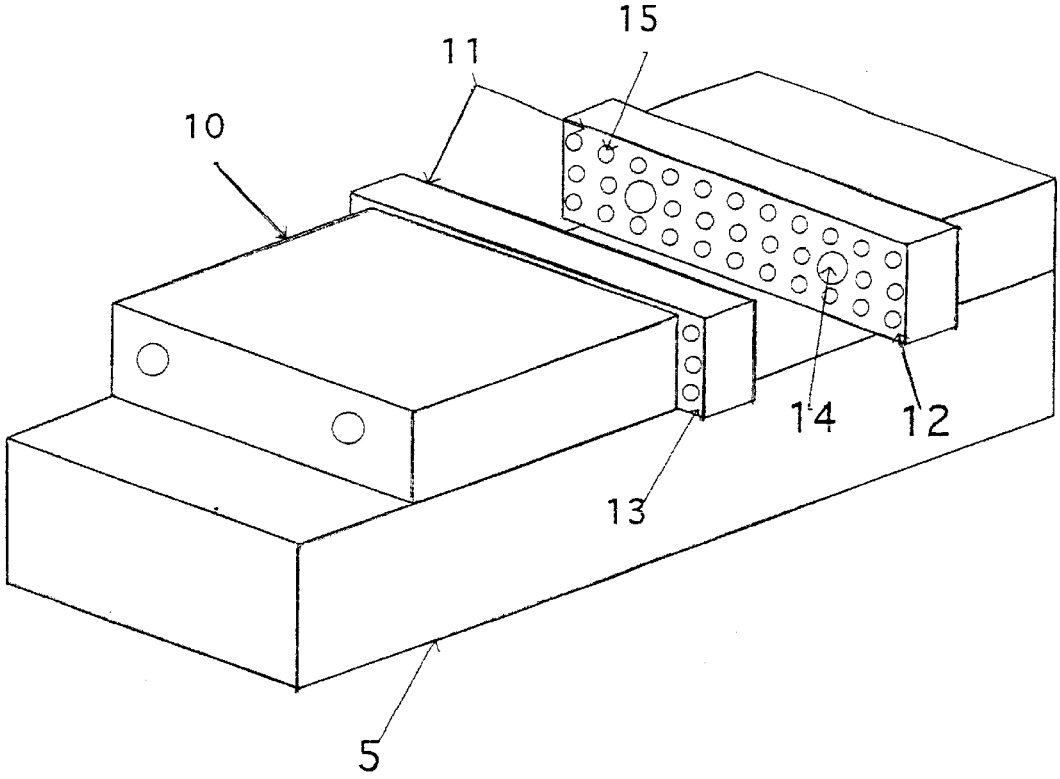
FIG. 1 is a perspective view of a vise with vise jaw plates of the present invention.
Figure 2:
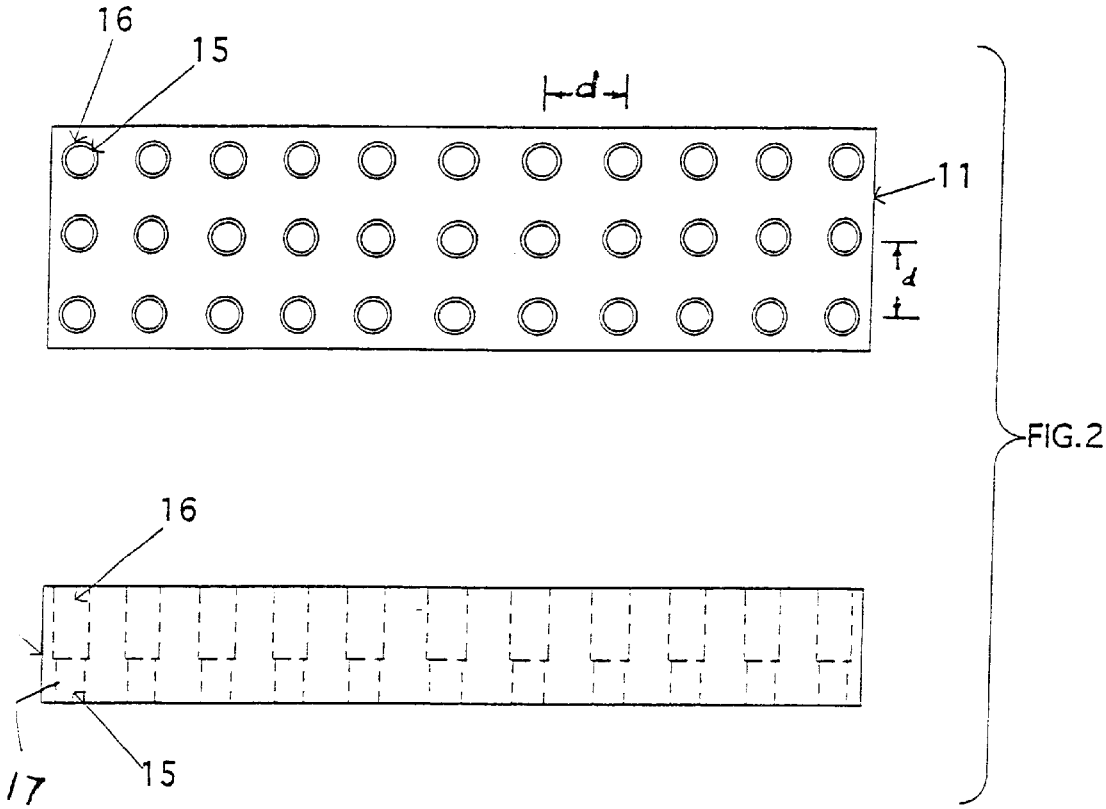
FIG. 2 is are front and side views of a vise jaw plates.
Figure 3:
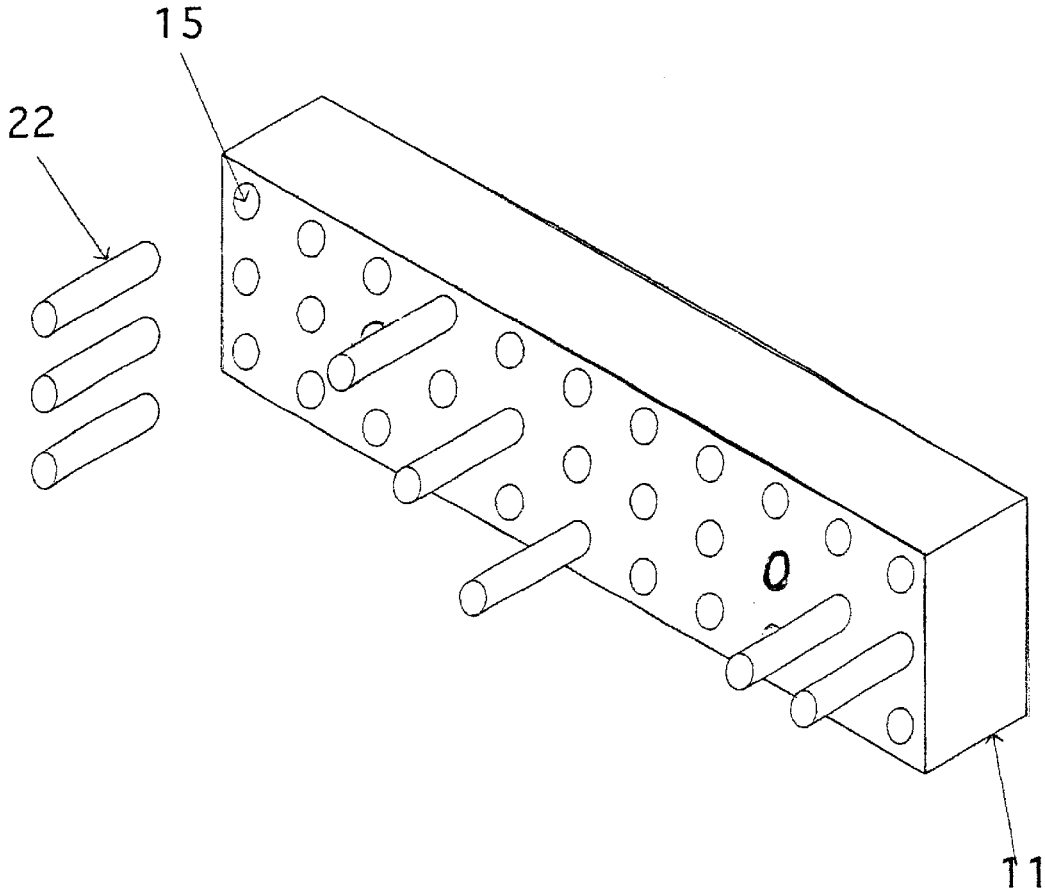
FIG. 3 shows a plurality of dowels sized to fit in holes of the versatile vise jaw.
Figure 4:
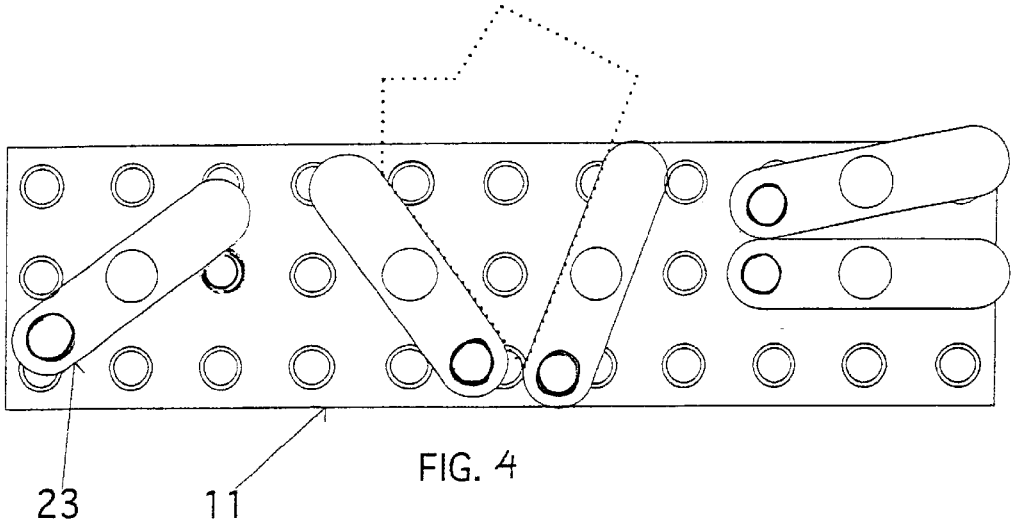
FIG. 4 shows a front view of pivot bars on vise jaw plates supporting an odd-angled object.
Figure 5:
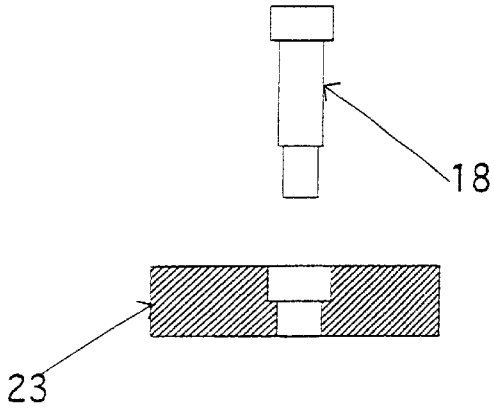
FIG. 5 shows a cross section of the pivot bar with a shoulder bolt.
Figure 6:
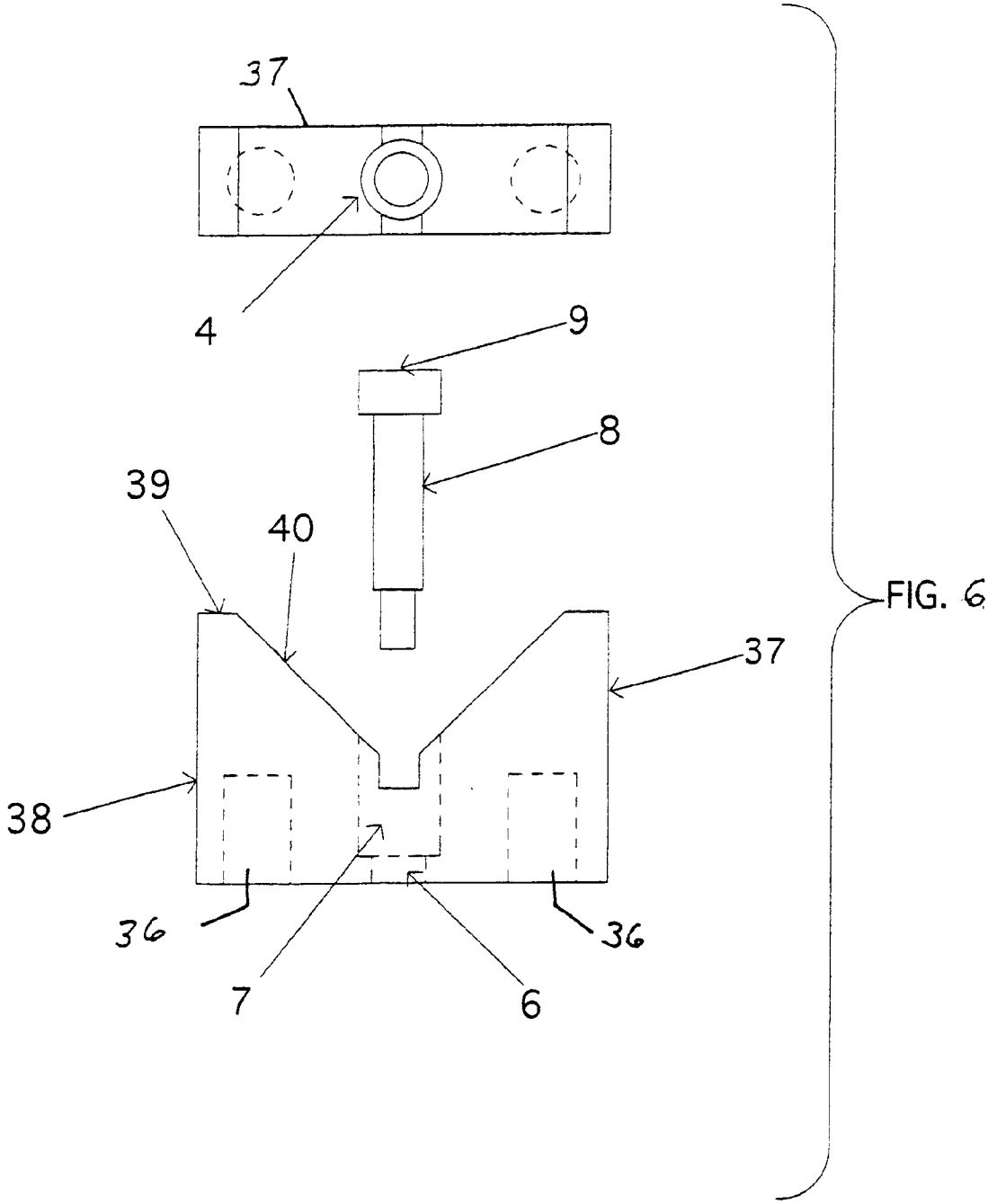
FIG. 6 are side and end views of a V-block.
Figure 7:
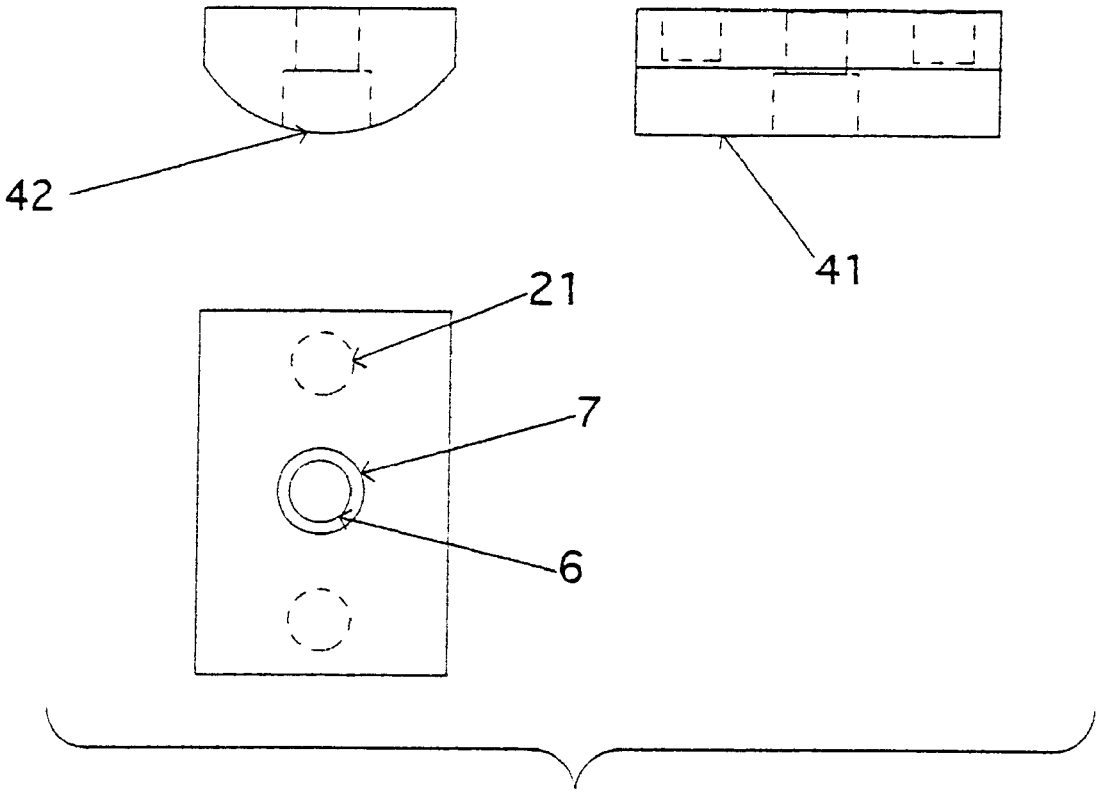
FIG. 7 are top, side, and end views of an arc block.
Figure 8:
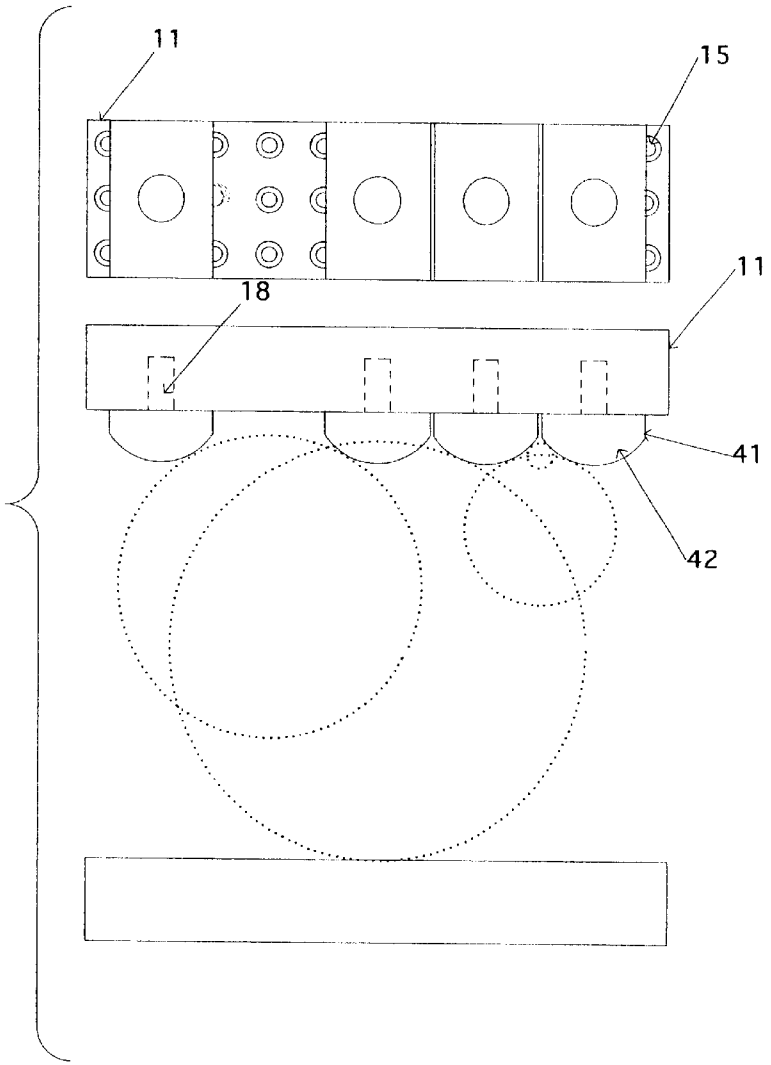
FIG. 8 are front and top views of an arc block. The top view shows the arc block securing an odd-shaped part between the pair of plates.
Figure 9:
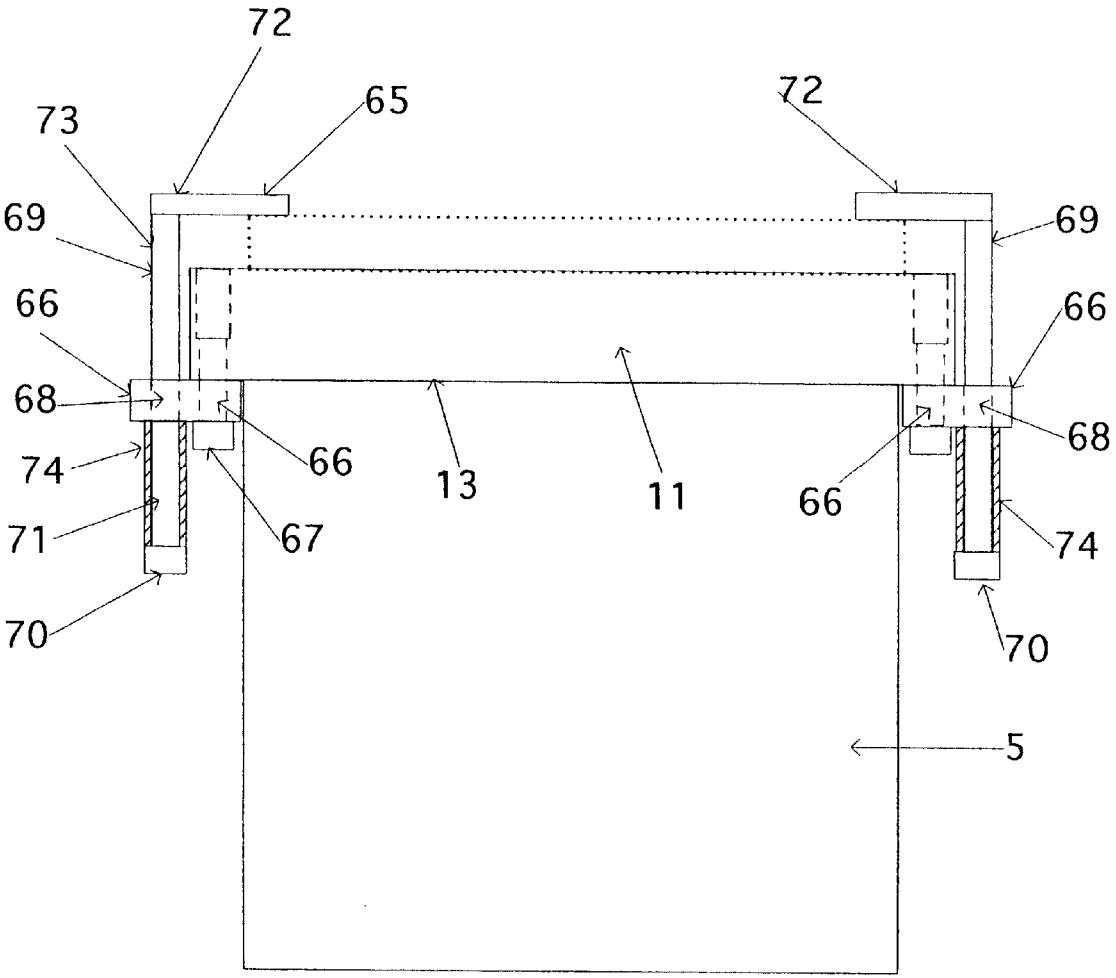
FIG. 9 is a top view of a parallel keeper.
Figure 10:
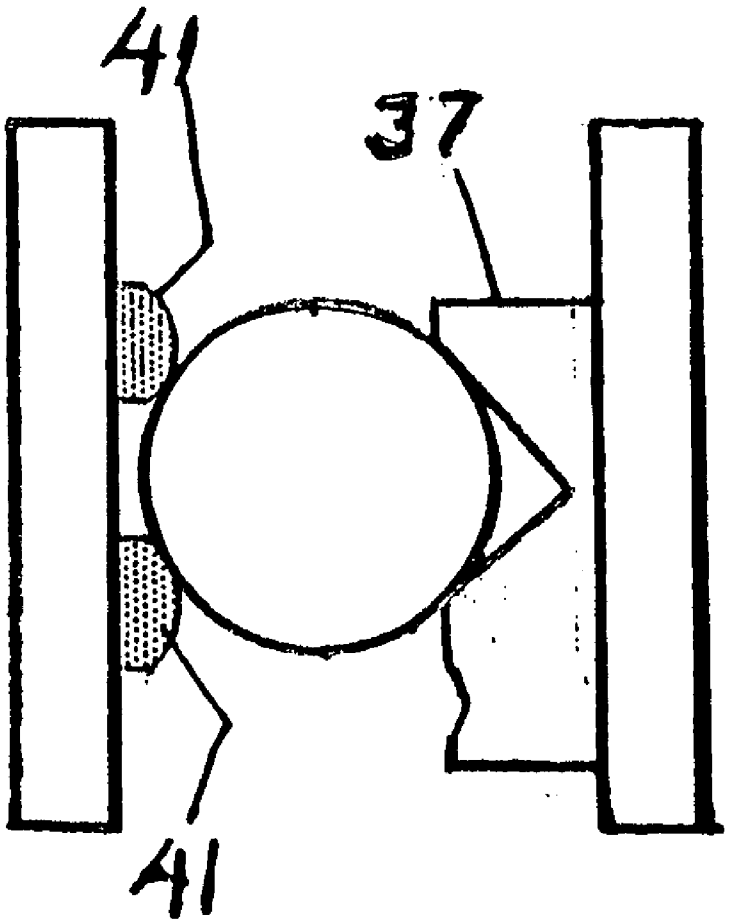
FIG. 10 is an end view of arc blocks mounted on a plate and a V-block mounted on an opposing plate shown cooperating to support a round part.

Referring to the drawings, the present invention comprises a versatile vise jaw 10 for use with a vise 5 and at least one work piece holder and typically two or more holders selected from a collection of work piece holders for use therewith as my be required in securing an object of arbitrary shape between vise plates.

The vise jaw comprises first and second opposing jaw plates 11 each with parallel, flat front and back sides 12 and 13. Each plate comprises a precise uniform pattern of same-sized plate holes 15 aligned vertically and horizontally in an orthogonal pattern with centers of holes 15 spaced apart from neighboring hole centers a same distance, d. Each hole 15 has an unthreaded portion 16 for receiving a dowel with its depth greater than its diameter, typically at least double its diameter, for securing the dowel in the hole unthreaded portion. Each hole 15 further has a threaded portion 17 immediately following the unthreaded portion having diameter less than that of the unthreaded portion and suitable for receiving a bolt from a work piece holder.

The jaw plates may also have one or more vise mounting holes 14 for mounting the plates to typical vise jaws.

At least one work piece holder, and typically two or more holders, are employed in concert with each other and the plates to secure a work piece between the plates. The work piece holder may employ at least one of a threaded bolt matching the plate hole threaded portion or a cylindrical post 18 matching the plate hole unthreaded portion. When employing at least two of either a threaded bolt or a cylindrical post, they are spaced apart a same distance, d, to match positions of the plate holes for positioning the work piece holder at any preferred position on the plates.

Figure 12:
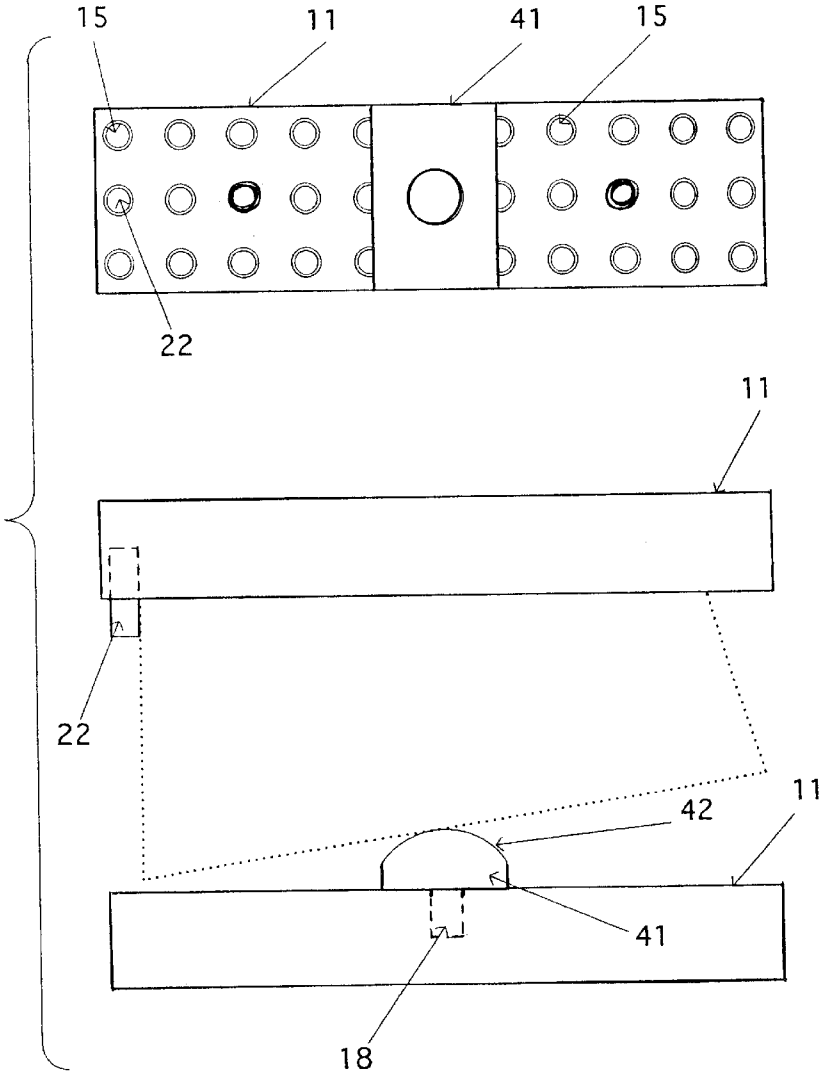
FIG. 12 are three views showing an arc block and a dowel cooperating to support an odd-shaped object.
Figure 13:
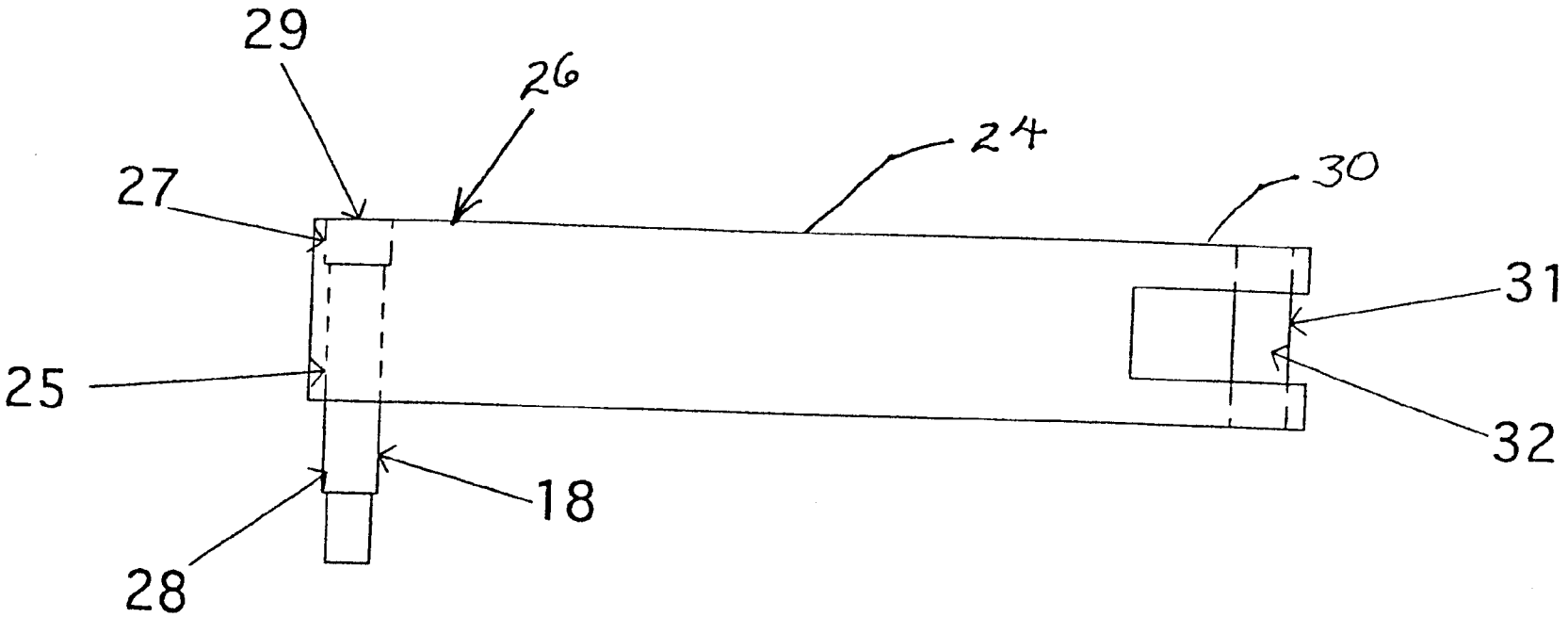
FIG. 13 is a side view of a sine bar.

A first work piece holder comprises one or more dowels 22 sized to fit closely in plate hole 15 of appropriate length sufficient to extend from the plate hole unthreaded portion to support an work piece on the plate. FIG. 12 shows the dowel employed in concert with an arc block (described below), both mounted on the plates to secure a work piece between the plates.

A second work piece holder is an arc block 41 having a continuous curvilinear top 42, such as such as a top having a semicircular cross-section, forming an arc directed longitudinally outward toward the opposite plate. That is, the curvilinear top may comprise a right semi cylinder. When the arc block is mounted on a plate, the top is directed toward the opposing plate. To secure the arc block 41 to the vise jaw plates 11, a post sized to match the plate holes is directed away from the top.

Figure 11:
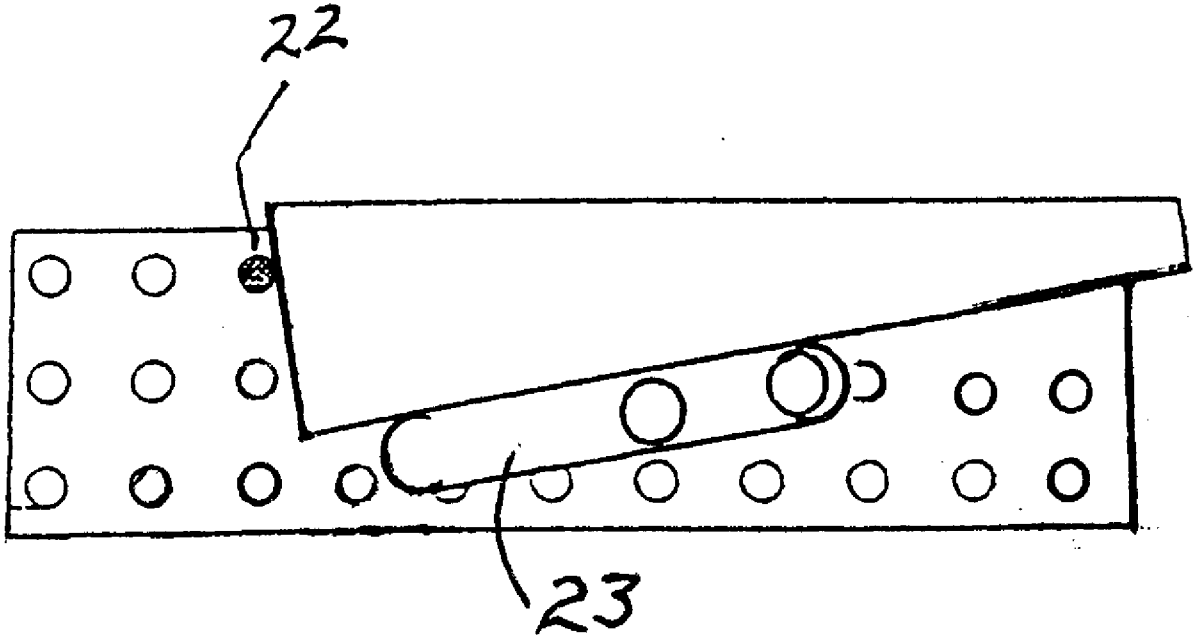
FIG. 11 is a front view of a pivot bar and a dowel both mounted on a plate and together cooperating to support an odd-shaped figure.

A third work piece holder comprises an elongated pivot bar 23 with a cylindrical post 18 intermediate its length on which the bar 23 may pivot when inserted in a hole unthreaded portion 16. The bar 23 can be secured in position when the post 18 is a shoulder bolt threaded into a plate hole threaded portion 17. As with other work piece holders, the pivot bar is used in concert with at least one other selective work piece holder to secure a work piece between the vise plates. FIG. 11 shows the pivot bar employed in concert with a dowel.

Figure 14:
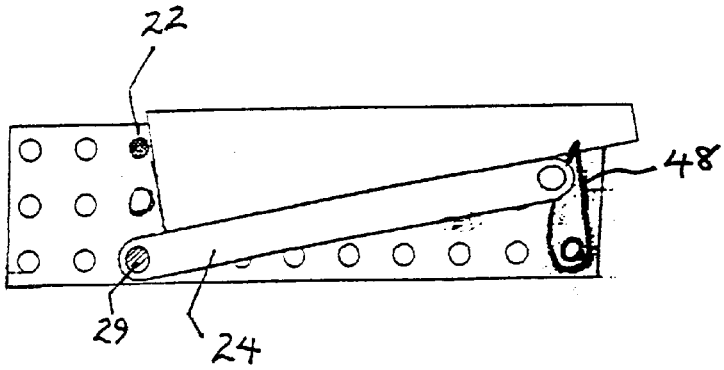
FIG. 14 is a front view of a sine bar resting on a curvilinear side block together cooperating to support an odd-shaped object.
Figure 15:
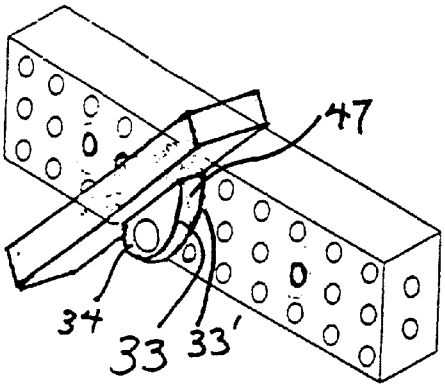
FIG. 15 is a perspective view of a curvilinear side block mounted on a plate and supporting an object on its flat surface at an arbitrary angle.
Figure 16:
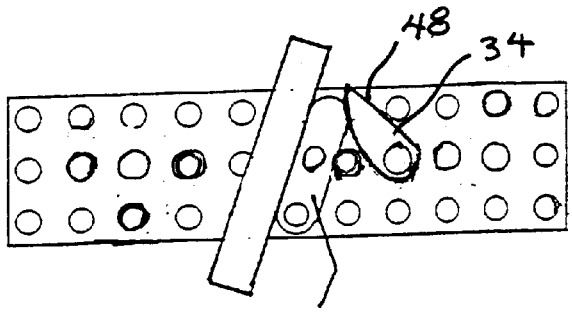
FIG. 16 is a front view of a pivot bar resting on a curvilinear surface to support an object at an arbitrary angle.

A fourth work piece holder comprises an elongated sine bar 24 with a shoulder bolt 28 in a bar hole 25 on a first sine bar end 26 on which the bar 24 may pivot. Typically, the bar hole 25 has a concentric countersunk hole 27 for receiving the bolt 28 with its head 29 in the countersunk hole. The bolt 28 can be tightened into the plate hole threaded portion 17 to prevent further pivoting and to establish a positive attachment to the plate. On a second sine bar end 30 is a longitudinal slot 31 with a cylindrical support pin 32 extending across the slot 31 as a support point for the sine bar 24. A further work piece holder, such as a cam block 47 (described below) or a support block (not shown) is employed with the sine bar 24 under the support pin to support the sine bar second end 30 at a desired height. The cam block when employed is mounted in a plate hole and rotated as preferred under the sine bar support pin 32. Likewise, the support block 33 is position on the vise under the support pin. FIG. 14 shows the sine bar employed in concert with a dowel and a curvilinear side block.

A fifth work piece holder is a V-block 37 comprising a parallelepipedonal base 38 with a top 39 having a triangular transverse cross-sectional recess 40 and a bolt hole 6 through its top 39 with a concentric countersunk hole 7 through which a bolt 8 may pass. With a hole 6 centered on the "V" and another hole 36 on each side each spaced apart from the center hole said same distance, d, a dowel in the side holes 36 mounts the V-block to the jaw in either a vertical or horizontal orientation, or alternatively, a single dowel mounted in the center hole 6 allows the block to pivot to accommodate nonstandard shapes at any desired angle. As a further alternative for obtaining a positive attachment of the V-block to one of the plates, a bolt 8 is threaded into the plate hole threaded portion with a bolt head 9 enclosed in the countersunk hole 7.

The top 39 with recess 40 is directed away from said dowels in the side holes 36 such that when the dowels are mounted in a first vise plate the recess 40 is directed toward a second plate of said opposing plates and disposed to receive and secure a work piece between said plates and also establishes lateral stops preventing transverse movement of the work piece between the plates.

A sixth work piece holder comprises a curvilinear side block 34 including a front and back 33, 33' separated by a noncircular curvilinear contact surface 35 and having a pivot hole offset 47 from center and a shoulder bolt on which the curvilinear side block pivots, the bolt passing through the pivot hole engaging with the plate hole threaded portion therein providing positive attachment of the work piece holder to one of said plates. The curvilinear side block work piece holder may also comprise a straight planar contact surface 48 separating said front and back in a plane normal to said front and back at which the curvilinear contact surface terminates.

One skilled in the art will recognize the advantages taught by this invention and illustrated by the preferred embodiment presented. The specification and drawings are not intended to represent an exhaustive description of the invention. Clearly, for example, additional and different support accessories may be combined for use with the versatile vise jaw. These and other obvious applications and extensions of the invention are intended to be within the spirit and scope of this invention.

What is claimed is:

1. A versatile vise jaw mountable to a vise, the improvement comprising a pair of opposing jaw plates, at least one of said jaw plates having a uniform orthogonal pattern of same-sized plate holes, the plate holes being aligned in rows and columns with each hole center respectively spaced apart a same distance, d, from its nearest holes both in its respective row and in its respective column such that a work piece holder with at least two posts each matching a plate hole and with post centers spaced apart a same distance, d, fits equally well in plate holes at any position throughout the hole pattern, in which each plate hole is adapted to receive both an unthreaded post and a threaded bolt, including an unthreaded portion sized to receive said work piece holder mounting post, the mounting hole immediately beyond the recess threaded to receive a threaded bolt, the hole unthreaded portion being of depth suitably greater than its diameter for securing a post in the hole unthreaded portion, and means for mounting said jaw plates to a vise.

2. A versatile vise jaw mountable to a vise, the improvement comprising, a pair of opposing jaw plates, at least one of said jaw plates having a uniform orthogonal pattern of same-sized plate holes, the plate holes being aligned in rows and columns with each hole center respectively spaced apart a same distance, d, from its nearest holes both in its respective row and in its respective column adapted to receive two posts of a work piece holder in two of said nearest holes, each post matching a plate hole with post centers spaced apart said same distance, d, and, means for mounting said jaw plates to a vise, a first work piece holder mountable in a first plate of said opposing jaw plates in at least one of said plate holes and including at least one post matching and removably secured in said at least one of said plate holes, wherein said first work piece holder comprises an arc block mountable on said first plate including a curvilinear top forming an arc opposite the at least one post and directed longitudinally outward and away from said first plate and toward a second plate of said opposing plates for receiving a work piece with a surface against the arc block curvilinear top nonplanar with said first plate, the arc block thereby securing such nonplanar work piece between said plates and also establishing a stop preventing lateral movement of said work piece in a first transverse direction.

3. A versatile vise jaw mountable to a vise, the improvement comprising, a pair of opposing jaw plates, at least one of said jaw plates having a uniform orthogonal pattern of same-sized plate holes, the plate holes being aligned in rows and columns with each hole center respectively spaced apart a same distance, d, from its nearest holes both in its respective row and in its respective column adapted to receive two posts of a work piece holder in two of said nearest holes, each post matching a plate hole with post centers spaced apart said same distance, d, and, means for mounting said jaw plates to a vise, a first work piece holder mountable in a first plate of said opposing jaw plates in at least one of said plate holes and including at least one post matching and removably secured in said at least one of said plate holes, a second work piece holder mountable on one of said opposing jaw plates in at least one of said plate holes and including at least one post matching and removably secured in said at least one of said plate holes, said second work piece holder and said first work piece holder disposed in cooperative relation on said opposing jaw plates to receive a work piece therebetween together receiving a work piece with a surface against the work piece holders, each respectively securing such nonplanar work piece between said plates and also establishing a stop preventing lateral movement of said work piece in a transverse direction, wherein said first work piece holder comprises an arc block mountable on said first plate including a curvilinear top forming an arc opposite the at least one post and directed longitudinally outward and away from said first plate and toward a second plate of said opposing plates for receiving a work piece with a surface against the arc block curvilinear top nonplanar with said first plate, the arc block thereby securing such nonplanar work piece between said plates and also establishing a stop preventing lateral movement of said work piece in a first transverse direction and wherein said second work piece holder comprises a second arc block also including a curvilinear top forming an arc directed longitudinally outward toward the opposite plate.

4. The invention of claim 2 further comprising a dowel removably mounted in at least one of said opposing jaw plates in one of said plate holes, said dowel in cooperative relation with said first work piece holder to receive a work piece therebetween, said dowel establishing a second stop and together with said first work piece holder preventing lateral movement of said work piece between the plates.

5. A invention mountable to a vise, the improvement comprising a pair of opposing jaw plates, at least one of said jaw plates having a uniform orthogonal pattern of same-sized plate holes, the plate holes being aligned in rows and columns with each hole center respectively spaced apart a same distance, d, from its nearest holes both in its respective row and in its respective column adapted to receive two posts of a work piece holder in two of said nearest holes, each post matching a plate hole with post centers spaced apart said same distance, d, and, means for mounting said jaw plates to a vise, a first work piece holder mountable in one of said opposing jaw plates in at least one of said plate holes and including at least one post matching and removably secured in said at least one of said plate holes, a second work piece holder mountable in one of said opposing jaw plates in at least one of said plate holes and including at least one post matching and removably secured in said at least one of said plate holes, wherein said first and second work piece holders are disposed in cooperative relation on the jaw plates to receive an irregularly shaped work piece therebetween and sandwiched between the vise jaw plates, said first work piece holder providing a first lateral limit preventing said work piece from sliding transversely between the vice jaw plates in a first lateral direction and said second work piece holder providing a second lateral limit preventing said work piece from sliding transversely between the vice jaw plates in second lateral direction opposite the first, said work piece receivable between said first and second work piece holders laterally and secured against them as lateral limits to transverse movement of the irregularly shaped work piece as the vice jaw plates tighten against the work piece longitudinally, wherein at least one of said first and second work piece holders comprises an arc block including a curvilinear top forming an arc directed longitudinally outward toward the opposite plate.

* * * * *